United States Patent [19]

Bachman, Jr. et al.

[11] 4,163,414

[45] Aug. 7, 1979

[54] METHOD OF ERECTING FLAT FOLDED CASES

[75] Inventors: Joseph L. Bachman, Jr.; George E. Ginther, Sr., both of King of Prussia; A. David Johnson, Jr., Radnor, all of Pa.

[73] Assignee: Wayne Automation Corp., Bridgeport, Pa.

[21] Appl. No.: 771,166

[22] Filed: Feb. 23, 1977

[51] Int. Cl.[2] ..... B31B 1/76

[52] U.S. Cl. ..... 93/53 M; 93/53 SD

[58] Field of Search ..... 93/53 SD, 53 M, 53 R, 93/49 R

[56] References Cited

U.S. PATENT DOCUMENTS

| | | | |
|---|---|---|---|
| 3,552,280 | 1/1971 | Jaroch | 93/53 SD |
| 3,888,164 | 6/1975 | Taddei | 93/53 R |
| 3,956,976 | 5/1976 | Vogel et al. | 93/53 SD |

*Primary Examiner*—James. F. Coan

*Attorney, Agent, or Firm*—Frederick J. Olsson

[57] ABSTRACT

Flat folded four-panel case is set up in a vertical take-down plane. The case is pulled out of the plane and manipulated to cause the four panels to move relative to each other so that the case assumes a diamond shape. The case is then partially erected. Next, one of the panels is held fixed (with the others being free to move) and a bottom flap is folded inwardly. This transmits forces to the panels so that the diamond shape changes to a square shape and the case is fully erected.

5 Claims, 13 Drawing Figures

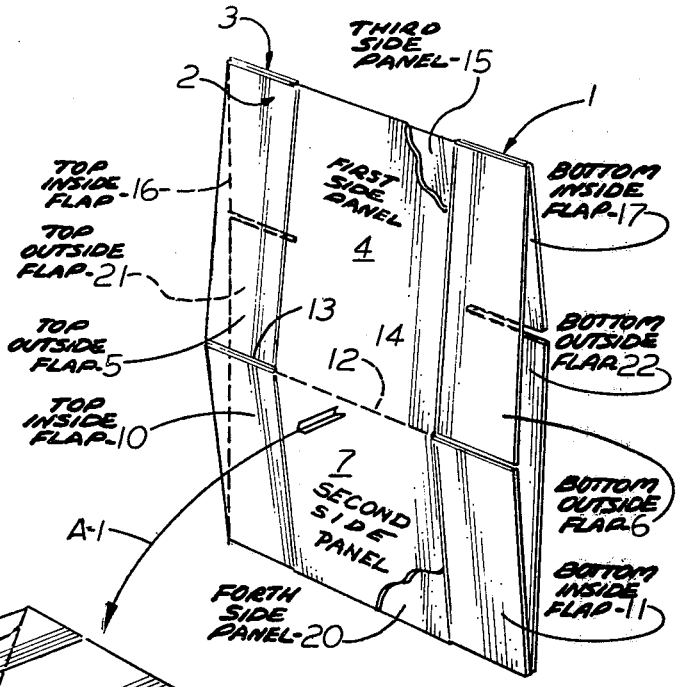
FIG. 1-A
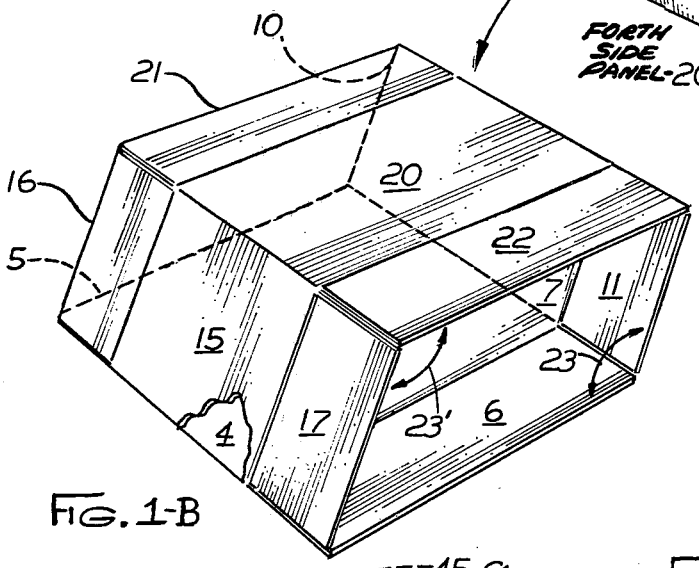
FIG. 1-B
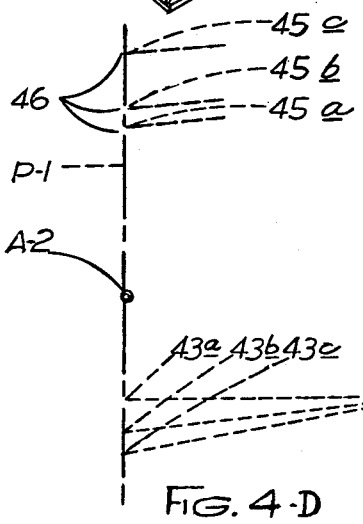
FIG. 4-D
FIG. 4-A
FIG. 4-B
FIG. 4-C
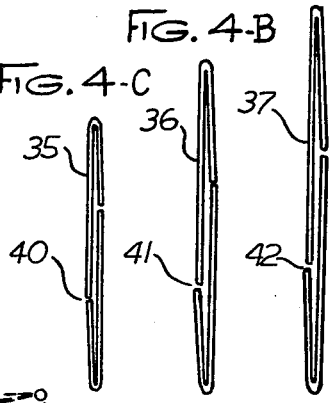

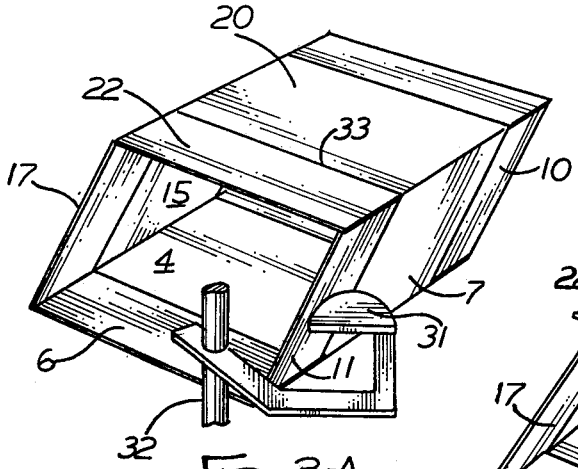
FIG. 3-A
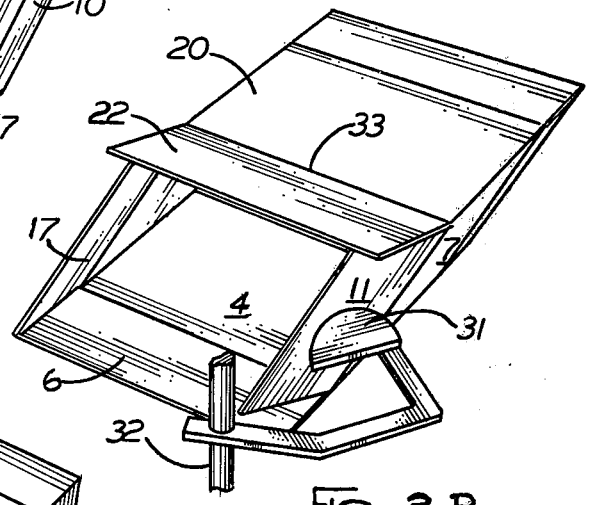
FIG. 3-B
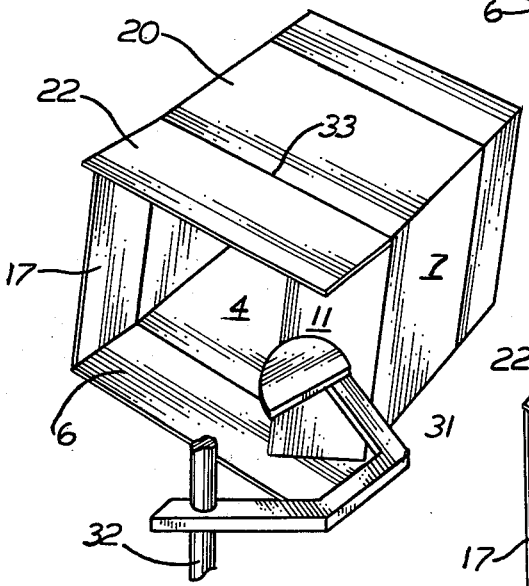
FIG. 3-C
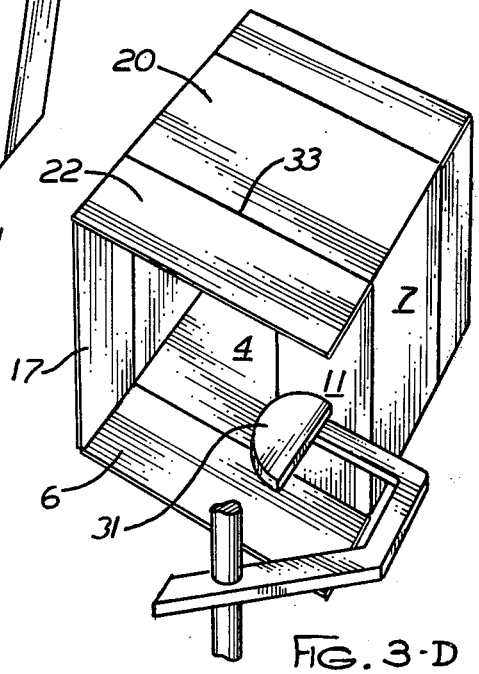
FIG. 3-D

METHOD OF ERECTING FLAT FOLDED CASES

This invention relates in general to flat folded shipping containers or cases and in particular relates to a method for erecting such cases in ready condition for the gluing or stapling of the bottom flaps.

One of the principal objects of the invention is to provide a method for erecting flat folded cases wherein the cases are stored in a magazine, taken out one-by-one from the magazine, and then erected with the foregoing operations being performed sequentially along a linear axis.

Another of the principal objects of the invention is to provide a method for erecting flat folded cases involving the concept of first manipulating the case so as to partially erect the same and then, while one of the side panels is fixed and the others are free to move, inwardly folding one of the inside bottom flaps to develop forces on the case to cause the same to fully erect.

Another of the principal objects of the invention is to provide in a method of the kind in question the step of placing each case in the take-down plane so that a preselected score line is substantially co-axial with a fixed and predetermined horizontal axis and maintaining this condition irrespective of the dimensions of the side panels and flaps.

The advantages flowing from the attainment of the foregoing objects are: (a) substantial saving in floor space for a machine adapted to carry out the method; (b) at least a five fold increase in the number of cases that can be stored in a magazine; and (c) a large decrease in the number of parts and functions of the mechanisms necessary to manipulate the cases from the flat folded condition to the fully erected condition.

The manner in which the method is practiced will be apparent from the description below taken in conjunction with the drawings wherein:

FIGS. 1-A and 1-B are diagramatic views, FIG. 1-A illustrating a flat folded case in the flat condition and FIG. 1-B illustrating the case in the partially erected condition.

Figure 6:
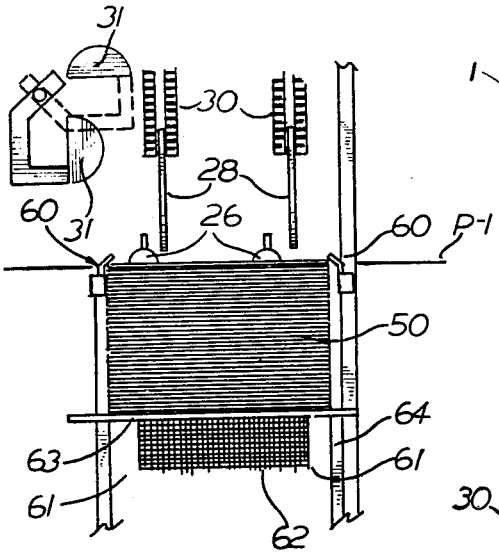
Figure 5:
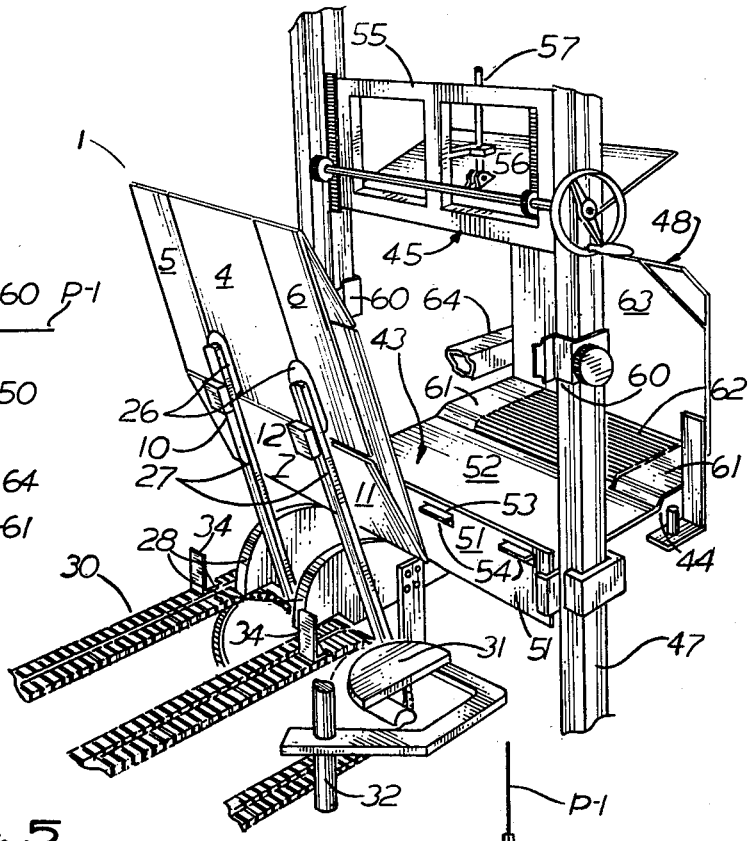
Figure 2:
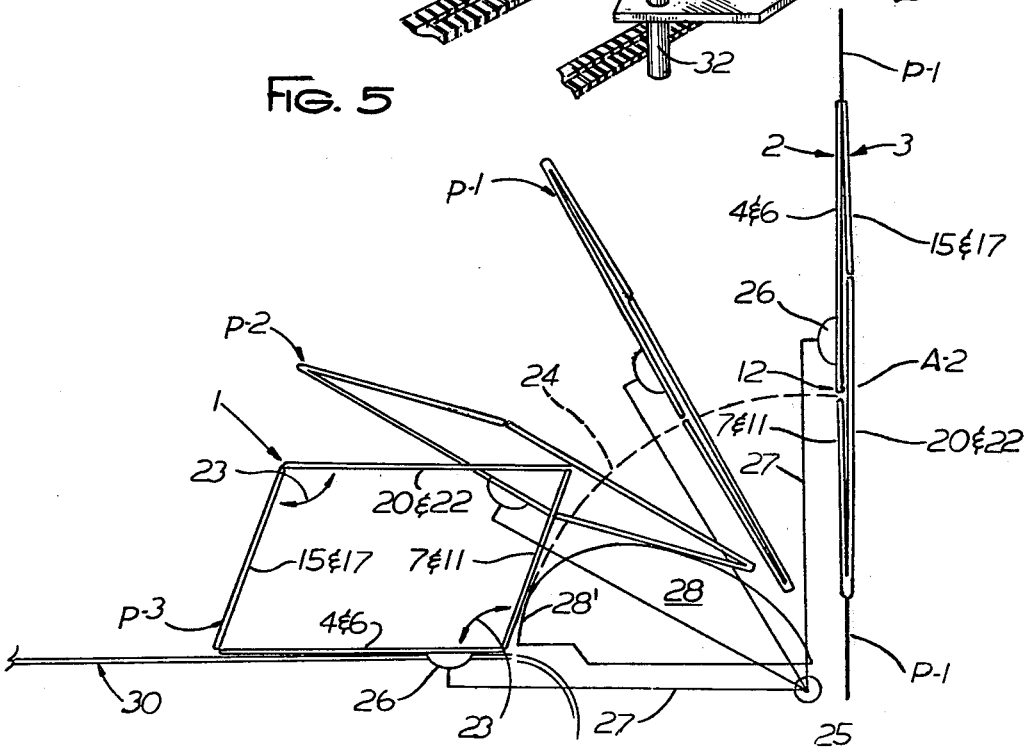

FIG. 2 is a diagrammatic sequential view illustrating the manner in which the case is manipulated to move from the takedown plane to the partially erected condition;

FIGS. 3-A thru 3-D are diagrammatic sequential, perspective views illustrating the manner in which the case is manipulated in going from the partially erected to the fully erected condition;

FIGS. 4-A thru 4-D are diagrammatic views illustrating the concept of positioning the score line of any case placed in the takedown plane along a fixed horizontal axis irrespective of the size of the case;

FIG. 5 is a perspective fragmentary view illustrating the general arrangement of a machine adapted to practice the method of the invention; and FIG. 6 is a fragmentary plan view of the machine of FIG. 5.

In FIG. 1-A a flat folded case 1 is shown oriented generally in a vertical direction. The case is illustrated as being slightly opened or with the faces 2 and 3 spaced apart. This is for descriptive purposes. Normally the faces 2 and 3 would be tight together.

The case 1 is typical of the type of case on which the method is practiced. The face 2 has a first side panel 4 with top outside flap 5 and bottom inside flap 6. The face 1 also includes the second side panel 7, below the panel 4 and having top inside flat 10 and bottom inside flap 11. The panels 4 and 7 are separated by score line 12 and their flaps by the slots 13 and 14.

The face 3 has a third side panel 15 with top inside flap 16 and bottom inside flap 17. The face 3 also includes the fourth side panel 20 having top outside flap 21 and bottom outside flap 22.

It will be understood that the pairs of adjacent panels 4-15, 15-20 and 20-7 are separated by score lines (like score line 12) and that the flaps are separated by slots similar to slots 13 and 14. The pairs of adjacent panels can relatively move about the score lines and this allows the case to open into a diamond or square shape. Each flap is separated from its panel by a score line (which extends between the ends of slots) and score line allows the flap to be folded inwardly.

According to the invention, the flat folded case 1 shown in FIG. 1-A is moved in the direction of the arrow A-1 and manipulated into a partially opened or erected condition as shown in FIG. 1-B. In the partially open position the first side panel 4 and its flaps 5 and 6 have been moved down counter-clockwise from the position of FIG. 1-A and are horizontally oriented. The second side panel 7 and its flaps 10 and 11 extend upwardly at an obtuse angle 23. The third and fourth panels and their flaps are respectively parallel to the first and second panels and extend at the same obtuse angle 23'. When in the partially erected or diamond shape condition, the bottom inside flap 11 is folded inwardly to generate forces which fully erect the case as will be explained later.

The manner of manipulating the case as between FIG. 1-A and FIG. 1-B will be explained in connection with FIG. 2.

FIG. 2 shows a side elevational view of the case 1. Reference to the top flaps 5, 10, 16 and 21 is omitted. The plane of the case extends in a vertical takedown plane P-1. Panel 4 and bottom flap 6 are above the panel 7 and flap 11. The score line 12 of the case is co-axial with the datum axis A-2 which is in a fixed predetermined position. Each succeeding case put into the takedown plane P-1 is positioned with the plane of the case as shown and with the corresponding score line co-axial with the datum axis A-2. A preferred way of supporting the cases and putting the same into the takedown plane will be commented on later.

After positioning the case in the takedown plane, the panel 4 and flap 6 are gripped and moved counter-clockwise (as viewed in FIG. 2) to a position where the panel 4 and flap 6 extend horizontally. For illustrating this motion, the case 2 is depicted in two intermediate positions p-1 and p-2 and in the final, horizontal position p-3. The panel 4 and flap 6 are moved so that the score line 12 moves along the arc 24 whose center is indicated at 25.

While the panel 4 and flap 6 are being moved, the second panel 7 and flap 11 are caused to rotate about the score line 12 toward the panel 4 and flap 6. This latter rotation is carried out so when the panel 4 and flap 6 are horizontal the panel 7 and flap 11 extend at the obtuse angle 23. The case is in the partially erected condition.

For manipulating the case from the closed position in the takedown plane to the partially erected position the tooling mentioned below may be conveniently employed. This tooling is indicated both in FIG. 1 and in FIG. 5.

A vacuum assembly includes cups 26 mounted on arms 27 pivoted for motion about the axis 25. The arms 27 move the cups so that the same securely grip the panel 4 and flap 6. A pair of erection cams 28 are sandwiched between the vacuum cup arms 27 and are adapted to be engaged by the panel 7 as the case moves down. As indicated in FIG. 2 this causes the panel 7 and the flap 11 to rotate in a direction toward the panel 4 (counter-clockwise as viewed in FIG. 2). The vacuum cups 26 bring the panel 4 and flap 11 down against a conveyor belt mechanism 30. This places the panel 4 and flap 11 in the horizontal orientation and the cams 28 have placed the panel 7 and its flap 11 at the obtuse angle 23. The case is now partially erected.

The belt 30 and vacuum cups 26 hold the panel 4 and flap 11 in fixed position during the full erection process. The process for fully erecting the case will be described in connection with FIGS. 3-A thru 3-D.

In FIG. 3-A, the case 1 is depicted as being in the partially erected condition. The panel 4 and flap 6 are held fixed. The sides 7, 20 and 15 and their flaps are free to move about the respective score lines. Under the foregoing conditions, a force is applied to the bottom inside flap 11 in a direction to cause the flap to fold inwardly to its fully inward position. This force is generated by a pusher 31 adapted to be rotated by the drive post 32 as between (see FIG. 6) the outboard position indicated by the full lines to the inboard position indicated by the dotted lines.

In FIG. 3-A the pusher 31 has been rotated inwardly and is just making contact with flap 11. With further inward rotation, say as between FIG. 3-A and FIG. 3-B, the flap 11 is caused to rotate inwardly. The top of the flap engages and begins to slide under the flap 22, which rotates upwardly. With further movement of the pusher, say as between FIG. 3-B and FIG. 3-C, the top of flap 11 begins to closely approach the score line 33. With this approach, a point is reached wherein the flap 11 starts to transmit forces to the panels 7, 15 and 20 to cause the same to move in directions to decrease the obtuse angles 23 and 23'.

With further rotation of the pusher 31 say, as between FIG. 3-C and FIG. 3-D, the flap 11 is moved to its fully inward position. The obtuse angles 23 and 23' have been decreased to substantially 90° and the box is fully erected.

The case is now ready for the other bottom flap 17 to be folded in. This is done by providing pushers 34 (see FIG. 5) on the conveyer 30 which will engage the panel 7 and (with the vacuum removed) push the case to the left past a fixed arm which will engage and cam in the flap 17.

If the case is to be glued, a glue spray or adhesive is automatically applied to the panels 11 and 17, and then, while the case is held fixed, the outside flaps 22 and 6 are folded inwardly to engage and be held in place by the adhesive.

If the bottom flaps are to be stapled, the above procedure is followed (except for the gluing) and a backup member is held against the bottom flaps while the same are stapled together.

In practicing the method wherein the flat folded cases are sequentially placed in the takedown plane, it is important that the score line of each case be placed in the same position. The reason is that the ending contour portion 28' of the erection cam 28 is fixed with respect to the arc 24 or axis 25 and therefor the side panel 7 will always easily slide down the cam surface and be properly positioned at the desired obtuse angle. In this way the erection process is independent of the size of the panels, for example, with reference to FIG. 2 it will be observed that a larger case with a panel having a width twice that of panel 7 would be positioned and partially erected the same as case 1.

FIGS. 4-A thru 4-D diagramatically illustrate the principle employed in a mechanism for accommodating various size cases to insure that the score line of the same is always placed in the same position.

Cases 35, 36 and 37 are each of different size. The cases have score lines 40, 41 and 42 similar to score line 12.

The dotted lines 43*a*, 43*b* and 43*c* represent a lower gate 43. The gate is elongated to provide a guide means for conducting the bottom of the cases into position. The gate is angularly adjustable about the axis 44 for accomodating cases of different size.

The dotted lines 45*a*, 45*b* and 45*c* represent an upper gate 45 in different vertical positions. The vertical adjustment is for accomodating different size cases. The gate is elongated to provide a guide means for conducting the tops of the cases into position. The elongated guide is angularly adjustable about a pivot located adjacent the takedown plane.

It will be apparent that with the lower gate in the position of 43*a* and the upper gate in position of 45*a* a case of the size of case 35 can be supported between the gates in the takedown plane. The score line 40 will be co-axial with the datum axis A-2.

With the lower gate in the position of 43*b* and the upper gate in the position of 45*b*, a case the size of case 36 will be positioned in the takedown plane with the score line 41 co-axial with the datum axis A-2.

With the lower gate in the position of 43*c* and the upper gate in the position of 45*c* a case the size of case 37 will be positioned in the takedown plane with its score line 41 co-axial with the datum axis A-2.

Certain components of the apparatus shown in FIGS. 5 and 6 have been mentioned above in connection with the explanation of the method. Additional comments with respect to the machine components used for practicing the method follow.

The framing 47 supports the lower gate 43 and the upper gate 45. To the right of the framing is the magazine section 48. The magazine section supports a pack of cases 50 (FIG. 6) and moves the same one by one into the takedown plane.

The lower gate has a bracket 51 extending between and connected to the framing 46, and an elongated guide 52 pivotally mounted on the end of the magazine section 48 by the pivot means 44. The top of the bracket 51 carries an apertured flange 53, the apertures slidably receiving the fingers 54 on the guide 52. The flange 53 and the portion of the guide 52 adjacent the flange hold the bottom of the case in the takedown plane.

The bracket 51 is vertically adjustable on the framing 47 so as to establish a desired adjusted position of the flange 53 and the guide 52, for example, as shown at 43*a*, 43*b* and 43*c*. The fingers 54 slide in the guide apertures and accommodate the motion.

The upper guide 45 has a bracket 55 vertically adjustable on the framing 47. The guide section 56 is pivotally connected to the bracket 55 and can be angularly adjusted to the desired orientation as by the adjuster 57.

The framing 47 carries holding fingers 60 which, in conjunction with the flange 53, releasably secure the case in the takedown plane. Neither the flange nor the fingers prevent the case from being extracted by the suction cups 26. Means are provided to vertically adjust the fingers on the framing.

The magazine section 48 includes appropriate framing which mounts a fixed platform 61, carrier belt 62, pressure plate 63 and an edge guide 64. The stack of cases 50 is hold between the pressure plate 63 and the flange 53/fingers 60 (see FIG. 6).

The pressure plate 63 is slidably mounted on the magazine frame and is moved by the carrier belt 62. The plate is joined with the belt by a quick-disconnect mechanism not shown. For loading the magazine, the pressure plate is disconnected from the belt and moved all the way to the rear and reconnected. The stack of cases is loaded on the carrier belt between the plate 63 and flange 53/fingers 60.

The edge guide 64 which is co-extensive with the magazine assists in maintaining the stack in-line. The edge guide is laterally adjustable to accomodate various sizes of cases.

The carrier belt is powered by a step or jog type drive so that as each case is taken out of the takedown plane the belt 62 and plate 63 jog forward to push another case into position. The carrier belt is spaced slightly above the platform 61 so that the belt and plate can move the whole stack as a unit.

We claim:

1. In a method of erecting a flat folded case one face of which has a first side panel including a bottom outside flap and a second adjacent side panel including a bottom inside flap and the opposite face of which has a third side panel including a bottom inside flap and a fourth side panel including a bottom outside flap, the steps of:

orienting said case with the plane of the case extending substantially vertically in a take-down plane and with the first side panel and its bottom outside flap being disposed above the second side panel and its bottom inside flap and with the score line between the first and second side panels extending substantially horizontally;

moving said first side panel and its bottom outside flap from said vertical orientation downwardly in an arc so the first side panel is in a horizontal orientation and performing said motion so that the score line moves down along an arc of a circle and at the same time causing the second side panel and its bottom inside flap to rotate about said score line toward the first panel so that the second side panel and flap extend at an obtuse angle to the first side panel when the same is in said horizontal orientation whereby the case is partially erected; and while the panels are in said obtuse orientation, holding said first side panel relatively fixed while permitting the other panels to relatively move and causing said obutse angles to decrease respectively to substantially 90° whereby the case is fully erected.

2. In a method of erecting a flat folded case one face of which has a first side panel including a bottom outside flap and a second adjacent side panel including a bottom inside flap and the opposite face of which has a third side panel including a bottom inside flap and a fourth side panel including a bottom outside flap, the steps of:

orienting said case with the plane of the case extending substantially vertically in a take-down plane and with the first side panel and its bottom outside flap being disposed above the second side panel and its bottom inside flap and with the score line between the first and second side panels extending substantially horizontally;

moving said first side panel and its bottom outside flap from said vertical orientation downwardly in an arc so the first side panel is in a horizontal orientation and performing said motion so that the score line moves down along an arc of a circle and at the same time causing the second side panel and its bottom inside flap to rotate about said score line toward the first panel so that the second side panel and flap extend at an obtuse angle to the first side panel when the same is in said horizontal orientation whereby the case is partially erected; and after said case is partially erected and while the panels are in said obtuse orientation holding said first side panel in fixed position while permitting the other panels to relatively move and moving the flap of the second side panel inwardly to its fully inward folded position, the inward motion causing the flap to engage and slide under the bottom outside flap of the fourth side panel and to transmit force to the panels to cause the same to move to decrease the obtuse angle between the first and second panels and the obtuse angle between the third and fourth panels until said obtuse angles decrease respectively to substantially 90° and the case is fully erected.

3. In the method of sequentially erecting flat folded cases, in each case one face of same having a first side panel including a bottom outside flap and a second adjacent side panel including a bottom inside flap and the opposite face of which has a third side panel including a bottom inside flap and a fourth side panel including a bottom outside flap, the steps of:

providing a plurality of said cases;

sequentially placing each case in a take-down plane wherein the plane of the case extends substantially vertically and with the first side panel and its bottom outside flap being disposed above the second side panel and its bottom inside flap and when each case is in said take-down plane the score line between the first and second side panels extending substantially co-axial with a fixed predetermined horizontal axis;

when a case is in said take-down plane moving the first side panel and its bottom outside flap from said vertical orientation downwardly in an arc so the first side panel is in a horizontal orientation and performing said motion so that the score line moves down along an arc of a circle and at the same time causing the second side panel and its bottom inside flap to rotate about said score line toward the first panel so that the second side panel and flap extend at an obtuse angle to the first side panel when the same is in said horizontal orientation whereby the case is partially erected; and while the panels are in said obtuse orientation, holding said first side panel relatively fixed while permitting the other panels to relatively move and causing said obtuse angles to decrease respectively to substantially 90° whereby the case is fully erected.

4. In the method of sequentially erecting flat folded cases, in each case one face of same having a first side panel including a bottom outside flap and second adjacent side panel including a bottom inside flap and the opposite face of which has a third side panel including a bottom inside flap and a fourth side panel including a bottom outside flap, the steps of:

providing a plurality of said cases;

sequentially placing each case in a take-down plane wherein the plane of the case extends substantially vertically and with the first side panel and its bottom outside flap being disposed above the second side panel and its bottom inside flap and when each case is in said take-down plane the score line between the first and second side panels extending substantially co-axial with a fixed predetermined horizontal axis;

when a case is in said take-down plane moving the first side panel and its bottom outside flap from said vertical orientation downwardly in an arc so the first side panel is in a horizontal orientation and performing said motion so that the score line moves down along an arc of a circle and at the same time causing the second side panel and its bottom inside flap to rotate about said score line toward the first panel so that the second side panel and flap extend at an obtuse angle to the first side panel when the same is in said horizontal orientation whereby the case is partially erected; and after said case is partially erected and while the panels are in said obtuse orientation holding said first side panel in fixed position while permitting the other panels to relatively move and moving the flap of the second side panel inwardly to its fully inward folded position, the inward motion causing the flap to engage and slide under the bottom outside flap of the fourth side panel and to transmit force to the panels to cause the same to move to decrease the obtuse angle between the first and second panels and the obtuse angle between the third and fourth panels until said obtuse angles decrease respectively to substantially 90° and the case is fully erected.

5. A method of erecting a flat folded case one face of which has a first side panel including a bottom outside flap and a second adjacent side panel including a bottom inside flap and the opposite face of which has a third side panel including an bottom inside flap and a fourth side panel including a bottom outside flap, the steps of:

taking a case and imposing forces on the same to move said side panels with respect to one another to a position wherein the first and second side panels and their respective flaps extend at an obtuse angle to one another and the third and fourth side panels and their respective flaps extend at an obtuse angle to each other whereby the case is partially erected; and while the panels are in said obtuse orientation holding one of the side panels in fixed position while permitting the other panels to relatively move and selecting one of the bottom inside flaps and moving the same inwardly to its fully inward folded position, the bottom flap being selected so that said motion causes the same to engage and slide under an adjacent bottom outside flap and transmit forces to the other panels to cause the same to move to decrease the obtuse angle between the first and second panels and the obtuse angle between the third and fourth panels until said obtuse angles decrease respectively to substantially 90° and the case is fully erected.

* * * * *